United States Patent [19]

Tisdale

[11] 4,271,684

[45] Jun. 9, 1981

[54] LOCKET ASSEMBLY

[76] Inventor: Clarence F. Tisdale, 30 Summit Ave., Goose Creek, S.C. 29445

[21] Appl. No.: 26,120

[22] Filed: Apr. 2, 1979

[51] Int. Cl.[3] ..... A44C 1/00

[52] U.S. Cl. ..... 63/19; 63/2; 24/3 F

[58] Field of Search ..... 63/18, 19, 1, 2, 3; 40/303, 13; 224/209, 241, 252; 24/3 F

[56] References Cited

U.S. PATENT DOCUMENTS

| | | | |
|---|---|---|---|
| 235,683 | 12/1880 | Jeanne et al. | 63/1 R |
| 273,057 | 2/1883 | Foster | 63/19 |
| 563,882 | 7/1896 | Rapaport | 63/19 |
| 1,455,840 | 5/1923 | Hill | 24/3 F |
| 1,475,782 | 11/1923 | Beach | 40/13 X |
| 1,794,625 | 3/1931 | Kaufman | 24/3 F |
| 2,401,556 | 6/1946 | Di Stiso | 63/2 |
| 2,418,410 | 4/1947 | Hull | 24/3 F |

FOREIGN PATENT DOCUMENTS

| | | | |
|---|---|---|---|
| 186097 | 6/1907 | Fed. Rep. of Germany | 40/13 |

*Primary Examiner*—F. Barry Shay
*Attorney, Agent, or Firm*—Robert D. Farkas

[57] ABSTRACT

A locket assembly utilizes a locket body and a hingeable cover thereto having a disengageable clasp member to secure the cover to the body in a closed position. The locket face may be solid or have a transparent portion so as to permit viewing of an indicia-bearing sheet disposed within the locket. A portion of the locket extends outwardly of the outermost surface of the body and is provided with a threaded hole for engaging a coupling element adapted to couple to other locket bodies in a string-like fashion. Each locket is provided with a plate hingeably secured to the rearmost surface of the locket and having a spring causing the plate to pivot in an outward position relative to the rearmost surface of the locket. A spring bias clasp is adapted to maintain the plate in a position parallel to the rear surface of the locket whereby a fabric-like tape may be clasped therein between providing support for the locket so as to permit a number of such lockets to be strung up into a necklace, each supported by the tape.

8 Claims, 7 Drawing Figures

LOCKET ASSEMBLY

BACKGROUND OF THE INVENTION

1. The Field of the Invention

This invention relates to lockets and more particularly to that class having an external clasping means for securing the locket to a supporting element and having decorative nonfunctional securing elements in addition thereto.

2. Description of the Prior Art

The prior art abounds with locket-type devices. U.S. Pat. No. 563,882 issued on July 14, 1896, to I. B. Rapaport teaches a locket having a front portion hingeably affixed to a body portion and having an eyelet-like mounting loop secured to the body portion for hanging locket from a chain or other apparatus. A lever extends outwardly from the rearmost surface of the locket utilized to open the hingeable portion of the locket upon manipulation thereof. The Rapaport apparatus relies solely upon the eyelet fastener secured to the body of the locket for supporting the apparatus.

U.S. Pat. No. 681,336 issued on Aug. 27, 1901, to D. D. Nevins discloses a locket body and a cover hingeably secured thereto utilizing a hinging mechanism secured within the base of the locket and to the innermost surface of the lid having a shiftable fulcrum design such that the lid may be lifted on the locket by depressing on the selected portion of the lid and having a concealed rim feature which hides the fact that the locket may be opened from the outside. The body of the locket is provided with a ring-like fastener for supporting the locket from a chain or other line-like apparatus. The Nevins device utilizes a functional loop which is always visible on the outside surfaces of the locket for supporting purposes, in similar fashion to the Rapaport apparatus.

SUMMARY OF THE INVENTION

A primary object of the present invention is to provide a means of mounting a locket to a tape member providing the principal support for the locket assembly.

Another object of the present invention is to provide a locket assembly having a decorative securing apparatus as opposed to a functional securing apparatus, at all times visibly accessible.

Still another object of the present invention is to provide a locket apparatus wherein a broad portion of the tape may be secured to the rearmost surface of the locket.

Yet another object of the present invention is to provide a locket assembly which may be strung together with other locket assemblies with great ease.

A further object of the present invention is to provide a locket apparatus which may be fabricated into a necklace form when desired.

Another object of the present invention is to provide a locket whose interior compartment may be viewed whilst the lid portion thereof is maintained in a closed position.

Still another object of the present invention is to provide a locket assembly having decorative joining components, utilized to join the locket assembly to other similarly constructed devices.

Heretofore, lockets were primarily provided having support consisting of an eyelet-like fastener secured to the body of the locket thereby enabling the apparatus to be hung only from a chain or a pin-like apparatus adapted to pass through a portion of the garments of the user. Necklaces and bracelets of conventional design oft times were utilized to support lockets in a freely hung position therefrom. Such devices failed to satisfactorily maintain the locket face in a preferred position, usually such that the lid portion of the locket was maintained parallel outwardly from an outermost portion of the garments of the user. Furthermore, lockets of any variety were unable to be added, one to another, so as to form a necklace or a string of lockets. The present invention recognizes these problems and overcomes the same by providing a locket apparatus having a decorative joining device or element which, whilst appearing to be functional in nature, disguises the true securing apparatus comprising a clasping plate located behind the rearmost wall of the locket which maintains the locket securely clasped to a tape-like element, flexible in nature, which may be worn as a necklace or bracelet, as desired. Hence, the finished appearance of the locket assemblies consists of metallic-like elements bringing a plurality of lockets together where in reality, each of the lockets of the assembly are clasped to the tape by the hidden member. In this fashion, each of the lockets are maintained parallel to the body of the user having the lid portions thereof maintained in an outermost relationship to the garment of the user. By making the lid transparent, indicia bearing sheets, located within the locket are visible at all times. Sophisticated designs, such as a heart design for each locket assembly, coupled together by a circlet of metallic material, may be utilized so as to create the appearance of the twelve signs of the Zodiac wherein the circlet represents the planet governing each sign. The joining elements, by being removably coupled to each locket may be removed when not required so as to form together any desired number of lockets in a single elongated chain or, if desired, into a Y-like necklace adapted to be worn about the neck of the user and having the leg portion of the Y-shaped necklace depend downwardly therefrom.

These objects as well as other objects of the present invention, will become more readily apparent after reading the following description of the accompanying drawings.

DESCRIPTION OF THE PREFERRED EMBODIMENT

Figure 1:
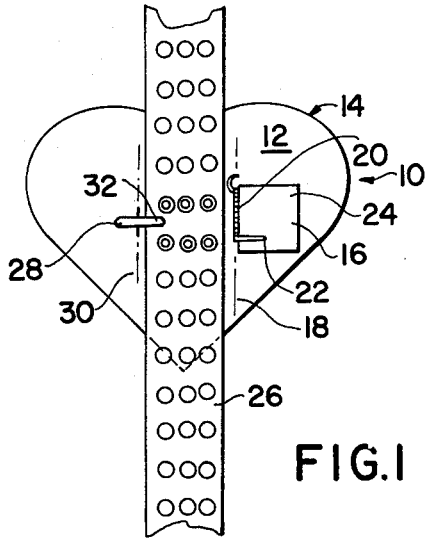
FIG. 1 is a front elevation view of the rear surface of the locket shown behind a portion of supporting tape.

The structure and method of fabrication of the present invention is applicable to a locket apparatus having a locket body and a locket lid hingeably secured thereto at a location adjacent to the marginal edges of the body and the marginal edges of the lid, such marginal edges having virtually identical shapes. One portion of the body of the locket is provided having a tapped hole therein. Another portion of the locket is provided having a rod-like appendage extending outwardly therefrom to which is affixed a small circle of metallic material. The outermost region of the metal circle is provided with a tapped hole. A joining element is utilized to join a series of lockets together having a large circlet of metal, in ring form, fixedly secured to a smaller ring of metal and having a pair of threaded rods extending outwardly therefrom in a lined relationship and each extending along a line passing through the origin of each of the rings. The threaded rods are dimensioned to threadingly engage either of the threaded holes associated with the base of the locket. The lid may be solid in nature so as to be opaque, or if desired, may have a window-like area extending inwardly from the marginal edges of the lid, otherwise being fabricated from metallic-like material such as anodized aluminum, brass, copper, silver or gold. The body of the locket, including its appendage, may be fabricated from a similar metal. A plate is hingeably secured to the outermost rearmost surface of the locket body such that the plate when residing in a position parallel to the outermost surface of the body of the locket is substantially centered between the marginal edges of the locket. A spring, preferably in helical shape, passes about a pivot rod whose ends are secured to the outermost surface of the locket. The rod may be secured utilizing welding, brazing, or the like. One end of the spring is disposed in touching engagement with a first surface of the plate. The other end of the spring is disposed in touching engagement with the rear exterior surface of the locket body. The plate has a notch therein such that a pair of fingers are provided. Each of the fingers are bent so as to form loops partially or virtually totally encircling the rod. The spring is wound so as to act as biasing means for the plate whose free end is biased so as to have it's first surface, the surface contacting the spring disposed in a direction parallel and adjacent to the exterior surface of the base of the locket. When the plate is pivoted about the rod, the plate may be positioned so as to have the spring contacting, or first surface of the plate disposed in parallel adjacent relationship with the exterior surface of the locket body. When in this position, such surface may be utilized to grasp a flexible tape between the surface of the plate and the exterior rearmost surface of the body. A bar, having narrower width than the plate, is pivotally secured to the exterior rearmost surface of the locket body and has one end thereof disposed biased towards such exterior rearmost surface utilizing a hairpin, U-shaped spring therefor. One end of the spring is in touching engagement with the rearmost surface of the body of the locket, whilst the other end of the spring is disposed secured to the other end of the bar. Another pivot rod is utilized to pivotally secure the bar to the exterior rearmost surface of the locket body such that it is located intermediate the ends of the bar. When the plate is disposed clasping the flexible strap or band, the bar may be pivoted upwardly and outwardly from the rearmost surface of the locket body so as to allow the plate to be disposed manually parallel to the rearmost surface of the locket, such that the first surface of the plate is located away from the otherwise exposed rear surface of the locket, the other lateral surface of the plate being adjacent and parallel to the rear surface of the locket. Releasing the bar permits the free end thereof to engage the plate, maintaining the plate in a closed position against a surface of the band. In this fashion, lockets may be disposed in any desired position along the length of the band or strap and may have, when desired, the joining element disposed between adjacent lockets so as to create the impression that each locket depends from its neighbor locket utilizing the joining elements therefor. If desired, the joining elements may be removed, so as to support the lockets in spaced apart relationship along the length of the band. Furthermore, such joining elements may be utilized to support the lockets, without use of bands or straps, if desired. The locket lid is fabricated from metallic material, similar to the body portion of the locket and has a hinge, of conventional design, secured fastening the lid pivotally to the locket body. A clasp, of conventional design, may be utilized to maintain the lid in a closed position when desired. The transparent embodiment of the lid, may be fabricated from a transparent plastic material, such as cellulose acetate butyrate, or if desired, may contain such plastic material fixedly secured to a rim-like portion of the lid fabricated from a metal material similar to the body portion of the locket. The tape or band element may be fabricated from a fabric-like material, such as cotton or plastic webbing.

Now referring to the figures, and more particularly to the embodiment illustrated in FIG. 1 showing the present invention 10 comprising the rearmost surface 12 of the locket body portion 14. Plate 16 is shown secured to surface 12 and is pivotally secured thereto along dotted lines 18. Spring element 20 is disposed centered around dotted lines 18, having end 22 thereof disposed in touching engagement with surface 24 of plate 16. Flexible band or strap 26 is shown in touching engagement with surface 12 and positioned adjacent to plate 16. Bar 28 is pivotally secured to body 14 alongst dotted lines 30. End 32 of bar 28 is shown partially covering band 26.

Figure 2:
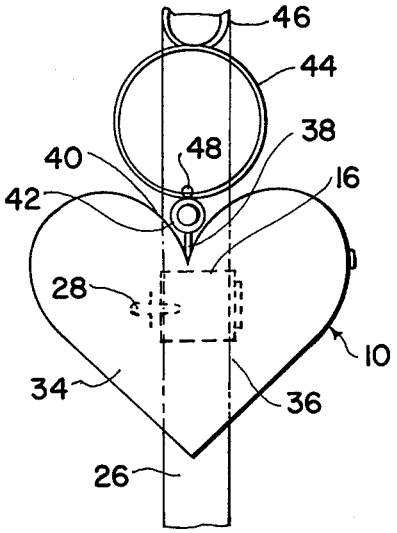
FIG. 2 is a front elevation view of a locket assembly shown having a portion of flexible tape there behind.

FIG. 2 illustrates lid portion 34 of the present invention positioned so as to conceal portions 36 of band 26. Plate 16 is shown in a closed position having portion 36 underneath plate 16 and having bar 28 located on top of plate 16. Rod-like member 38 is shown extending outwardly from the marginal edges 40 defining lid 34 and has a ring-like portion 42 secured to the free end thereof. Large ring 44 is shown secured to the end of rod-like element 38. Ring 46 is attached to ring 44 permanently. Ring 42 is threadingly engaged to ring 44 at point 48.

Figure 3:
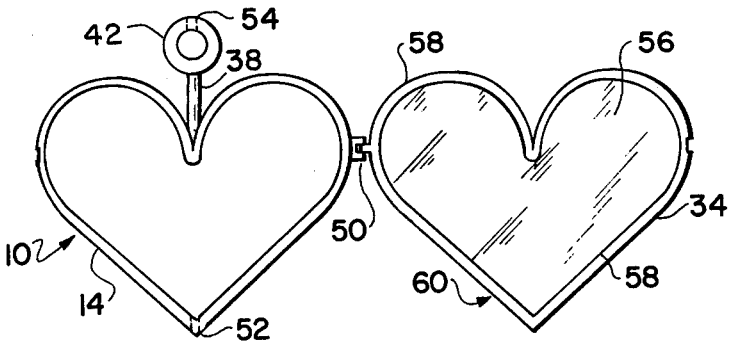
FIG. 3 is a front elevation view of a locket assembly having its lid portion in an open position.

FIG. 3 illustrates body portion 14 of present invention and has lid portion 34 hingeably secured thereto utilizing hinge apparatus 50. Threaded hole 52 is shown aligned with threaded hole 54. Lid 34 is provided having transparent portion 56 disposed substantially covering the entire surface thereof excepting for regions 58, extending somewhat inwardly from marginal edge 60, of lid 34. Ring 42 and rod-like member 38 is shown enlarged, in FIG. 3, relative to their depictions in FIG. 2, to more clearly indicate threaded holes 52 and 54.

Figure 4:
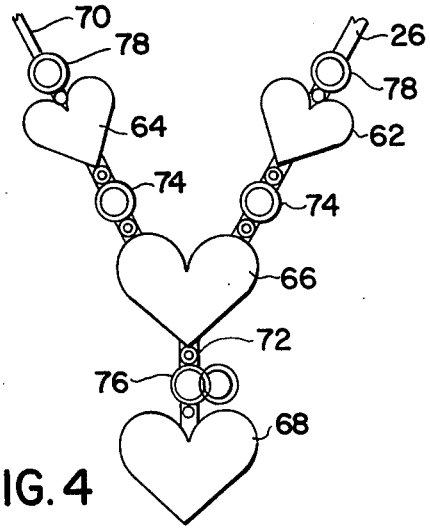
FIG. 4 is a front elevation view of a plurality of lockets shown suspended from a tape element.

FIG. 4 illustrates lockets 62 and 64 disposed above locket 66. Locket 68 is shown depending downardly from locket 66. Strap element 26 is utilized to support locket 62 whilst strap element 70 is utilized to support locket 64. Strap element 72, joined to strap elements 26 and 70, in a manner well known to the art, provides support for locket 68. Joining elements 74 join together locket 66 to locket 62 and 64. Joining element 76 joins together locket 68 to locket 66. It should be noted that joining elements 78 are disposed aligned with joining elements 74 whilst both joining elements 74 are askew to each other and joining element 76, such element having a different appearance from joining element 74.

Figure 5:
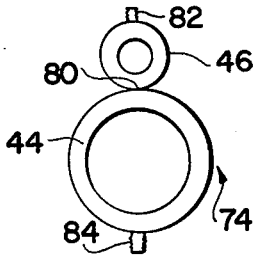
FIG. 5 is an elevation view of a joining element utilized in FIG. 4.

FIG. 5 illustrates typical joining element 74 comprising small ring 46 secured to large ring 44 at location 80. Threaded rod 82 extends outwardly from small ring 46 and is shown aligned with threaded rod 84. Threaded rods 82 and 84 are dimensioned so as to threadingly engage threaded holes 52 and 54, shown in FIG. 3.

Figure 6:
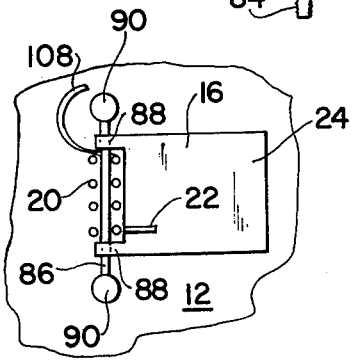
FIG. 6 is an enlarged partial elevation view of the apparatus shown in FIG. 1.

FIG. 6 illustrates plate 16 pivotally secured to pivot rod 86 utilizing fingers 88 therefor. Rod ends 90 are fixedly secured to surface 12. End 22 of spring 20 engages surface 24 of plate 16, whilst end 108 of spring 20 engages surface 12. A notch is disposed intermediate legs or fingers 88, providing clearance for some of the turns of helical spring 20.

Figure 7:
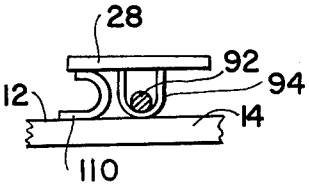
FIG. 7 is a side elevation cross-sectional view of a portion of the apparatus shown in FIG. 1.

FIG. 7 illustrates surface 12 of locket face 14 to which is affixed pivot rod 92. Eyelet 94 has its ends fixedly secured to bar 28. U-shaped spring 110 is provided having one end thereof engaging surface 12 whilst the other end thereof engages one end of bar 28. The other end of bar 28 extends outwardly from eyelet 94 for engagement with plate 16, shown in FIG. 2, when such plate is disposed clasping flexible band or strap 26, as shown therein.

One of the advantages of the present invention is to provide a means of mounting a locket to a tape member providing the principal support for the locket assembly.

Another advantage of the present invention is to provide a locket assembly having a decorative securing apparatus as opposed to a functional securing apparatus, at all times visibly accessible.

Still another advantage of the present invention is to provide a locket apparatus wherein a broad portion of the tape may be secured to the rearmost surface of the locket.

Yet another advantage of the present invention is to provide a locket assembly which may be strung together with other locket assemblies with great ease.

A further advantage of the present invention is to provide a locket apparatus which may be fabricated into a necklace form when desired.

Another advantage of the present invention is to provide a locket whose interior compartment may be viewed whilst the lid portion thereof is maintained in a closed position.

Still another advantage of the present invention is to provide a locket assembly having decorative joining components, utilized to join the locket assembly to other similarly constructed devices.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A locket assembly comprising a locket body, a lid, said lid hingeably secured to said body, a plate, means securing said plate to an exterior surface of said body for pivoting between an open and a closed position with respect to said surface, means to bias one end of said plate outwardly from said exterior surface toward said open position, a bar, said bar pivotally secured to said surface, means to bias one end of said bar towards said surface, whereby said one end of said bar is adapted to clasp said one end of said plate in said closed position maintaining said one end of said plate adjacent said surface, said plate being configured to be concealed behind said lid and said body when disposed in said closed position means comprising an element for joining said body to a third element, and means on said body to removably secure said joining element to said body.

2. The apparatus as claimed in claim 1 wherein a portion of said lid is transparent.

3. The apparatus as claimed in claim 1 wherein said joining element comprises a pair of threaded rods, said pair of threaded rods disposed in aligned relationship and extending outwardly from the marginal edges of a main portion of said joining element.

4. The apparatus as claimed in claim 1 wherein said lid is disposed in a closed position parallel to said exterior surface.

5. The apparatus as claimed in claim 3 wherein said main portion of said joining element comprises a pair of rings, said pair of rings fixedly secured to one another, said threaded rods extending outwardly of said rings having the longitudinal axis thereof extending along line passing through the origins of said rings.

6. The apparatus as claimed in claim 1 further comprising a flexible strap, said flexible strap being disposed parallel to said surface and in touching engagement therewith, said plate being disposed clasping said strap against said surface when said bar has said one end thereof in touching engagement with said one end of said plate.

7. The apparatus as claimed in claim 1 wherein said lid and said body are disposed having the marginal edges thereof forming a heart-like shape.

8. The apparatus as claimed in claim 7, further comprising a rod-like extension, said rod-like extension extending outwardly from said marginal edges opposite a pointed end of said heart-like shape, a ring, said ring fixedly secured to a free end of said rod-like extension, a threaded hole, said threaded hole being disposed in said body at said pointed end of said heart-like shape, another threaded hole, said another threaded hole being disposed in said ring, said threaded hole and said another threaded hole being disposed in a coaxial relationship.

* * * * *